US007393317B2

(12) United States Patent
Herman

(10) Patent No.: US 7,393,317 B2
(45) Date of Patent: Jul. 1, 2008

(54) CENTRIFUGE ROTOR-DETECTION OIL-SHUTOFF DEVICE

(75) Inventor: Peter K. Herman, Cookeville, TN (US)

(73) Assignee: Cummins Filtration IP, Inc., Minneapolis, MN (US)

( * ) Notice: Subject to any disclaimer, the term of this patent is extended or adjusted under 35 U.S.C. 154(b) by 319 days.

(21) Appl. No.: 11/104,114

(22) Filed: Apr. 11, 2005

(65) Prior Publication Data

US 2006/0229185 A1 Oct. 12, 2006

(51) Int. Cl.
*B04B 9/06* (2006.01)

(52) U.S. Cl. ..... 494/49

(58) Field of Classification Search ..... 494/24, 494/36, 43, 49, 64, 65, 67, 83, 84, 901; 210/168, 210/171, 232, 360.1, 380.1, 416.5; 184/6.24
See application file for complete search history.

(56) References Cited

U.S. PATENT DOCUMENTS 1,844,611 A * 2/1932 Spackman ..... 210/167.09
2,373,349 A * 4/1945 Serrell ..... 184/6.24
3,762,633 A * 10/1973 Ishii ..... 494/10
4,230,581 A * 10/1980 Beazley
4,334,994 A 6/1982 Jensen
4,346,009 A * 8/1982 Alexander et al. ..... 494/38
4,492,631 A * 1/1985 Martin ..... 210/127
5,904,841 A * 5/1999 Penny ..... 210/130
5,906,733 A * 5/1999 Purvey ..... 210/100
6,074,336 A * 6/2000 Purvey ..... 494/49
6,540,653 B2 4/2003 Herman et al.
6,974,408 B2 * 12/2005 Grosse-Wiesmann ..... 494/5
2004/0023782 A1 * 2/2004 Herman et al. ..... 494/49
2005/0020428 A1 1/2005 Grosse-Wiesmann
2006/0229185 A1 * 10/2006 Herman ..... 494/49

FOREIGN PATENT DOCUMENTS

GB 2113122 A * 8/1983
GB 2406893 A * 4/2006

* cited by examiner

*Primary Examiner*—Charles E Cooley
(74) *Attorney, Agent, or Firm*—Krieg DeVault LLP

(57) ABSTRACT

A centrifuge includes a housing that defines a fluid inlet port to supply fluid to the centrifuge and an axle cavity fluidly coupled to the fluid inlet port. A bearing is received in the axle cavity. A check valve is disposed in the axle cavity to minimize tampering, and the check valve is configured to control flow of the fluid from the inlet port. A rotor is configured to separate particulate matter from the fluid. The rotor includes an axle rotatably received in the bearing, and the axle defines a fluid passage to supply the fluid to the rotor. The check valve is normally biased towards a closed position where the flow of the fluid is shutoff. The axle is configured to open the check valve when the axle is received in the bearing.

19 Claims, 8 Drawing Sheets

CENTRIFUGE ROTOR-DETECTION OIL-SHUTOFF DEVICE

BACKGROUND

The present invention generally relates to centrifuges, and more specifically, but not exclusively, concerns a centrifuge system that is able to shutoff fluid to the centrifuge when the centrifuge rotor is missing or when the wrong rotor is installed.

Diesel engines are designed with relatively sophisticated air and fuel filters (cleaners) in an effort to keep dirt and debris out of the engine. Even with these air and fuel cleaners, dirt and debris, including engine-generated wear debris, will find a way into the lubricating oil of the engine. The result is wear on critical engine components and if this condition is left unsolved or not remedied, engine failure. For this reason, many engines are designed with full flow oil filters that continually clean the oil as it circulates between the lubricant sump and engine parts.

There are a number of design constraints and considerations for such full flow filters, and typically these constraints mean that such filters can only remove those dirt particles that are in the range of 10 microns or larger. While removal of particles of this size may prevent a catastrophic failure, harmful wear will still be caused by smaller particles of dirt that get into and remain in the oil. In order to try and address the concern over small particles, designers have gone to bypass filtering systems which filter a predetermined percentage of the total oil flow. The combination of a full flow filter in conjunction with a bypass filter reduces engine wear to an acceptable level, but not to the desired level. Since bypass filters may be able to trap particles less then approximately 10 microns, the combination of a full flow filter and bypass filter offers a substantial improvement over the use of only a full flow filter. Centrifuges, both self-driven and externally driven types, are routinely used for bypass filtering because of their ability to remove small particles from fluids like oil as well as other types of fluids.

A typical hydraulically-driven (Hero-turbine) centrifuge rotor is driven by the reaction force from one or more tangentially-oriented orifice jets. The orifices also serve to throttle or limit the flow rate through the rotor, since a bypass device must not be allowed to divert excessive flow back to the sump, which is typically 5-10% of pump outlet flow, maximum. If an operator inadvertently forgets to replace the centrifuge rotor during service, or installs an incorrect rotor with larger jets, the diverted bypass flow may be excessive, causing low oil pressure and associated engine wear.

Centrifuge systems have been proposed that automatically shutoff fluid flow when the rotor is not installed, but these systems have a number of drawbacks. For example, a centrifuge system has been proposed that has an outer sleeve slidably received around a shaft that supplies fluid to the centrifuge via openings in the shaft. Oil pressure or a spring is used to axially bias the sleeve so that it covers the openings in the shaft when the rotor is removed. However, such a system fails to prevent a wrong rotor from being installed, and due to its location, the sleeve can be easily damaged or tampered with so that it is rendered inoperable. Further, the relatively thin sleeve is hard to actuate. This type of system also has a number of detrimental affects on performance. Axially biasing the sleeve applies an axial load on the thrust surfaces of the bearings in the centrifuge, which in turn increases friction as well as wear. Bearings in centrifuges are normally very sensitive to any thrusting axial loads. Further, since the sleeve is not located on the axis of the centrifuge, but around the axis, a torque load is created that tends to slow the centrifuge's speed.

Thus, there is a need for improvement in this area of technology.

SUMMARY

One aspect concerns a centrifuge. The centrifuge includes a housing that defines a fluid inlet port to supply fluid to the centrifuge and an axle cavity fluidly coupled to the fluid inlet port. A bearing is received in the axle cavity. A check valve is disposed in the axle cavity to minimize tampering, and the check valve is configured to control flow of the fluid from the inlet port. A rotor is configured to separate particulate matter from the fluid. The rotor includes an axle rotatably received in the bearing, and the axle defines a fluid passage to supply the fluid to the rotor. The check valve is normally biased towards a closed position where the flow of the fluid is shutoff. The axle is configured to open the check valve when the axle is received in the bearing.

In another aspect, a centrifuge includes a rotor to clean fluid. An axle extends from the rotor, and the axle defines one or more flow passages through which the fluid is supplied to the rotor. A valve is configured to shutoff flow of the fluid when the rotor is absent or a wrong rotor type is installed to prevent pressure loss. The axle has an end contacting the valve to open the valve when the rotor is installed.

A further aspect concerns a method in which a housing is provided that includes a bearing disposed in a cavity in the housing and a check valve biased to cease fluid flow from an inlet port in the housing. The check valve is opened to allow the fluid flow by inserting an axle of a rotor into the cavity.

Further forms, objects, features, aspects, benefits, advantages, and embodiments of the present invention shall become apparent from the detailed description and drawings provided herewith.

DESCRIPTION OF SELECTED EMBODIMENTS

Figure 1:
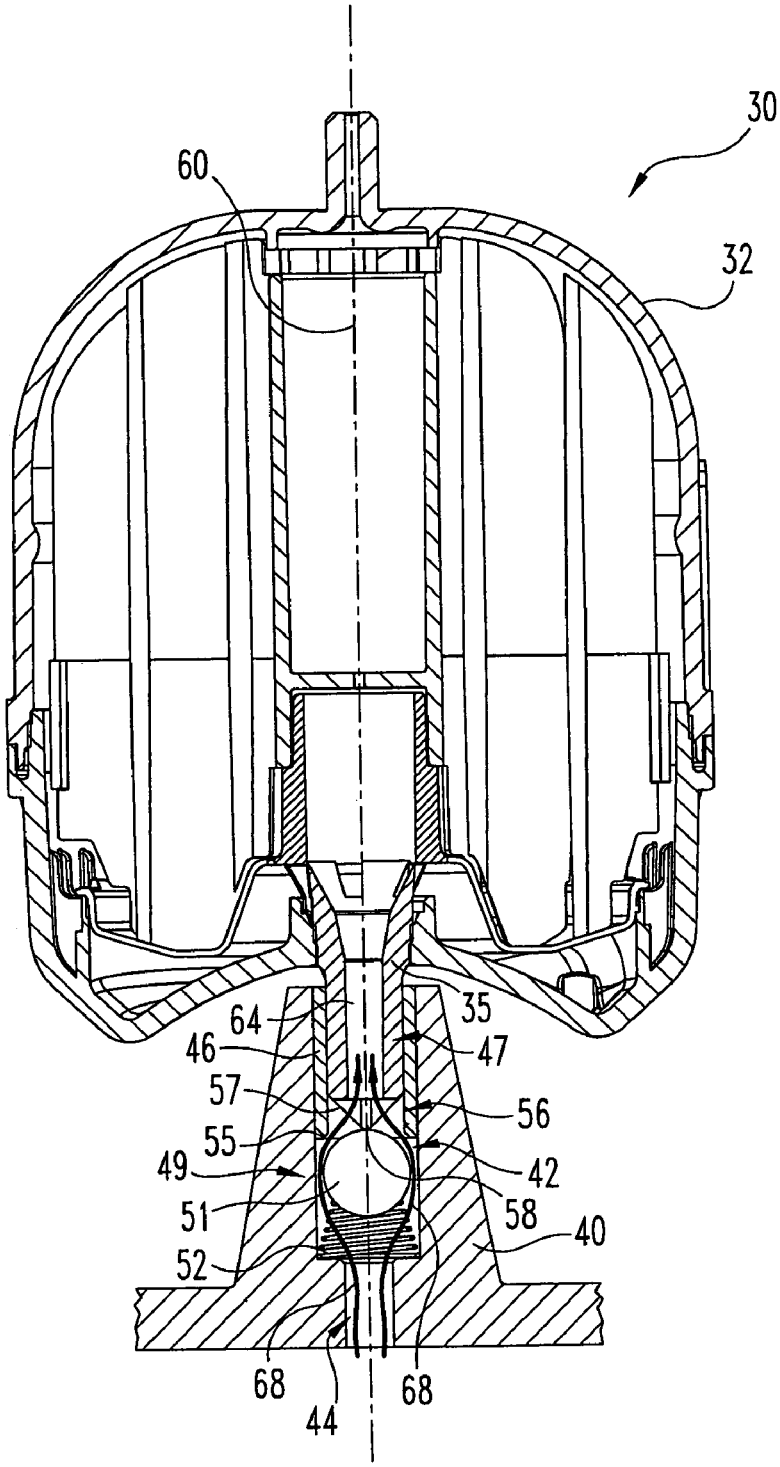
FIG. 1 is a cross-sectional view of a centrifuge assembly according to one embodiment.

For the purpose of promoting an understanding of the principles of the invention, reference will now be made to the embodiments illustrated in the drawings and specific language will be used to describe the same. It is understood that the specific language and figures are not intended to limit the scope of the invention only to the illustrated embodiment. It is also understood that alterations or modifications to the invention or further application of the principles of the invention are contemplated as would occur to persons of ordinary skill in the art to which the invention relates. One embodiment of the invention is shown in great detail, although it will be apparent to those skilled in the relevant art that some features that are not relevant to the present invention may not be shown for the sake of clarity.

A centrifuge assembly 30 according to one embodiment is illustrated in FIG. 1. As shown, the centrifuge 30 includes a centrifuge rotor 32 with an axle 35 (or sometimes referred to as a "spud") that is rotatably coupled to a housing 40. In the illustrated embodiment, the rotor 32 is a self driven type rotor, and in particular, the rotor 32 is a Hero-turbine type rotor with one or more jet orifices that drive the centrifuge 30, but it should be appreciated that the centrifuge 30 can include other types of centrifuges, like those disclosed in U.S. Pat. No. 6,540,653 to Herman et al., which is hereby incorporated by reference in its entirety. It should be recognized that the centrifuge 30 can clean fluids, like oil, as well as other types of fluids.

As mentioned previously, in some typical centrifuge designs, a shaft upon which the rotor rotates extends completely through the entire rotor. Such a shaft can be a friction source, which can have detrimental affects on performance, as well as can make assembly or disassembly of the rotor difficult for routine maintenance and the like. As can be seen, the centrifuge 30 has a shaft-less design, that is, a shaft does not extend through the rotor 32. By eliminating the shaft, assembly and/or disassembly of the centrifuge 30 is simplified and performance is enhanced. The housing 40 defines an axle cavity 42 in which the axle 35 is received. A fluid inlet port 44 for supplying fluid to the centrifuge 30 fluidly communicates with the axle cavity 42. Inside the axle cavity 42, the housing 40 has a bearing 46 that reduces friction between the axle 35 and the housing 40. In the embodiment depicted, the bearing 46 includes a journal bearing that is pressed fitted into the housing 40 such that the end of the bearing 46 facing the rotor 32 is flush with the housing 40. The journal bearing 46 in the illustrated embodiment is generally cylindrical in shape and defines an axle passage 47 in which the axle 35 is received. Between the fluid inlet port 44 and the bearing 46, the housing 40 has a valve 49 that is configured to shutoff the fluid supply when no rotor is installed or the wrong rotor is installed.

Figure 2:
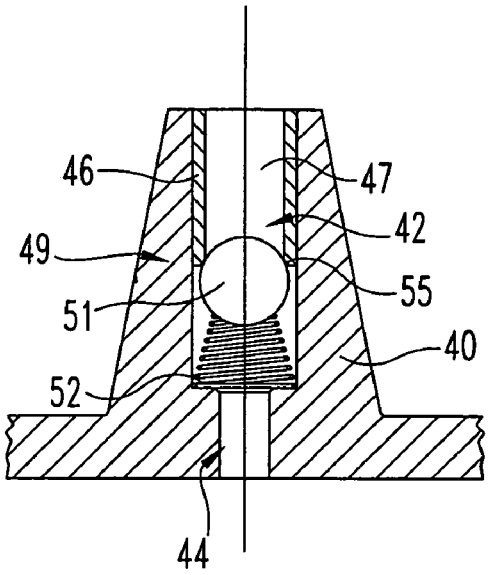
FIG. 2 is a cross-sectional view of the FIG. 1 centrifuge with a valve shutting off fluid flow when no rotor is installed.

As shown in FIGS. 1 and 2, the valve 49 includes a seal member 51 and a biasing member 52. The biasing member 52 normally presses the seal member 51 against a valve seat surface 55 on the bearing 46. At the valve seat 55, the bearing 46 is chamfered or beveled around the axle passage 47 so that the seal member 51 is able to be centered for ensuring a tight seal. In the FIG. 1 embodiment, the valve 49 is a check valve in which the seal member 51 is a ball and the biasing member 52 is a coil spring. However, it should be recognized that the valve 49 can include other types of valves. For instance, the seal member 51 can have a different shape in other embodiments, and the seal member 51 can be biased in other manners, such as solely through fluid pressure so that the biasing member 52 can be eliminated, if so desired. By way of non-limiting examples, the seal member 51 can be non-spherical, tapered, and/or plug-shaped, to name a few examples. With the valve 49 disposed inside the housing 40 and the bearing 46 retaining the valve 49 in the axle cavity 42, the chances of someone tampering with the valve 49 to defeat this safety feature is reduced.

Figure 3:
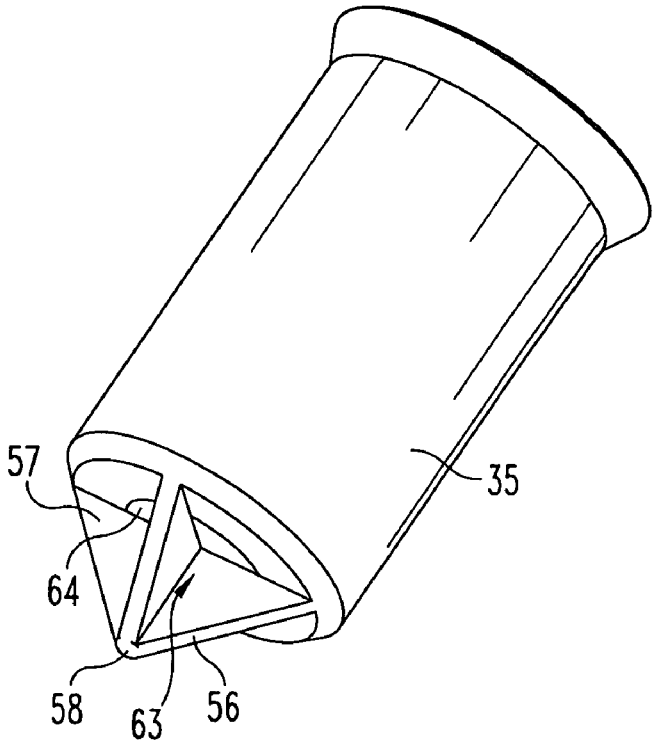
FIG. 3 is a perspective view of an axle for the FIG. 1 centrifuge.

With reference to FIGS. 1 and 3, the axle 35 has a protrusion or valve opening member 56 that is configured open the valve 49 when the proper rotor 32 is installed. In the embodiment shown, the protrusion 56 has an arrowhead shape with a series of one or more ribs 57 that are joined together at a contact point 58 where the axle 35 contacts the seal member 51. The contact point 58 is disposed along the central longitudinal axis 60 of the rotor 32 and the axle 35 so that only minimal torque is applied between the axle 35 and the valve 49. By reducing the torque applied between the axle 35 and the valve 49, the rotor 32 is able to rotate faster, thereby providing higher operational speeds. Further, with such a construction, the valve 49 can be easily actuated or opened when the proper rotor 32 is installed, thereby enhancing the durability and life of the centrifuge 30. Flow pathways 63 in FIG. 3 are formed between the ribs 57 to allow the fluid to flow into a fluid passageway 64 in the axle 35 that transfers the fluid to the rotor 32. With such a construction, the need for a central shaft in the centrifuge 30 is eliminated, which in turn boosts the operational speed and performance of the centrifuge 30. As mentioned previously, bearings in centrifuges are usually sensitive to axial loads such that even minor axial loading on the bearings can be detrimental to the rotational speed of the rotor 32. In the illustrated embodiment, once the rotor 32 is installed, axial loading on the bearings 46 is reduced so as to increase the speed of the rotor 32, and thus, enhance separation efficiency of the centrifuge 30.

Figure 4:
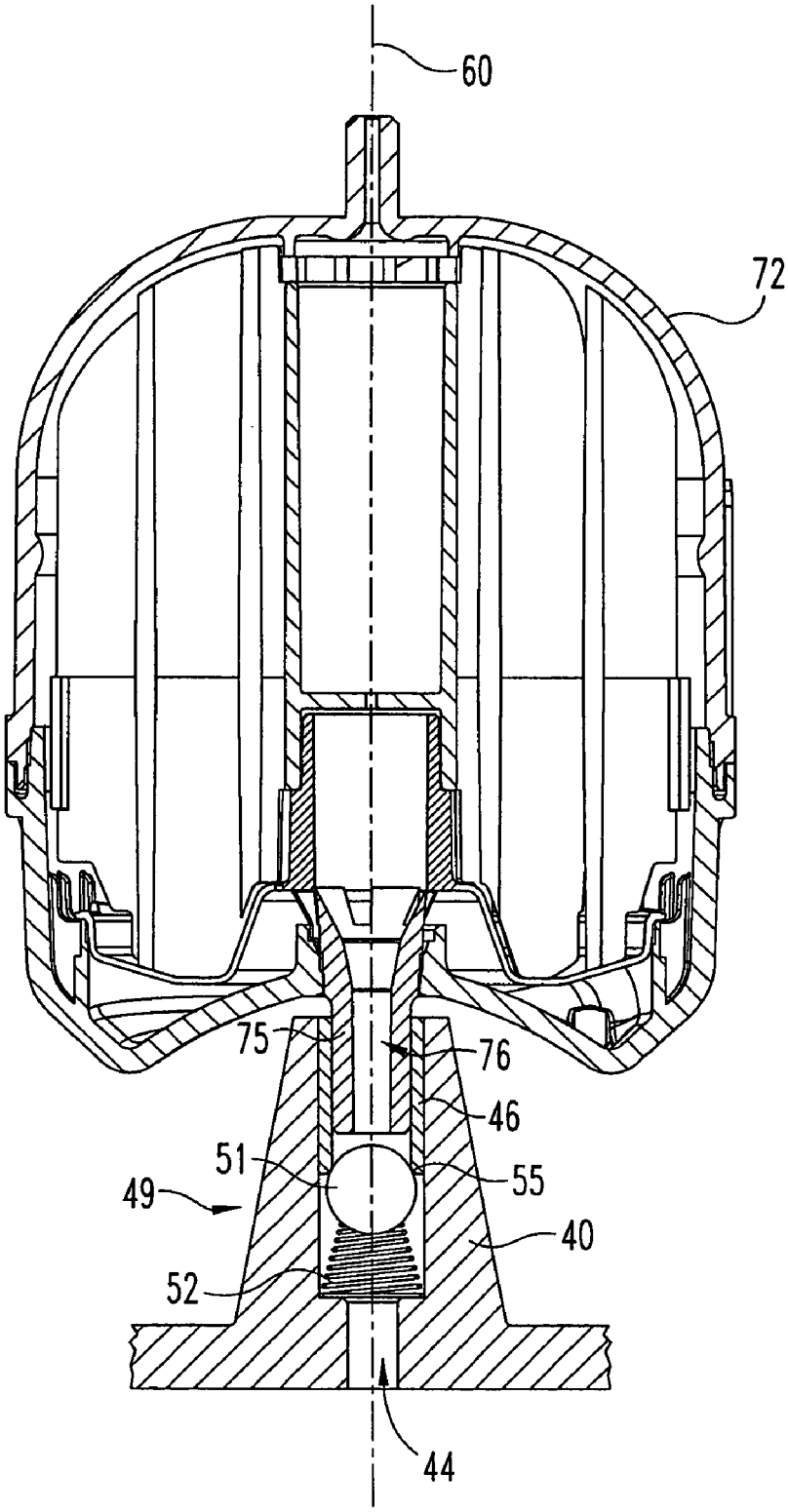
FIG. 4 is a cross-sectional view of the FIG. 1 centrifuge with the valve shutting off the fluid flow when the wrong rotor is installed.

When the proper rotor 32 is installed, the axle 35 on the rotor 32 pushes open the valve 49 in the manner as depicted in FIG. 1. Once the valve 49 is open, the fluid can flow around and past the seal member 51, into fluid passageway 64 in the axle 35, and into the rotor 32, as indicated by flow arrows 68. The fluid can then be cleaned and discharged through one or more jet orifices in the rotor 32 in order to drive the rotor 32. With reference to FIG. 2, when the rotor 32 is removed for maintenance or replacement, the biasing member 52 automatically closes the valve 49, thereby preventing a catastrophic loss of fluid pressure. Similarly, if the wrong rotor is installed, such as one with drive orifices that are too large for example, fluid pressure can likewise drop. FIG. 4 illustrates what happens when a wrong rotor 72 is installed. In the illustrated example, axle 75 of the incorrect rotor 72 is too short to open the valve 49. Consequently, the fluid is unable to flow into fluid passageway 76 of the axle 75, and thus, prevents excessive or incorrect bypass flow rate through the centrifuge.

Figure 5:
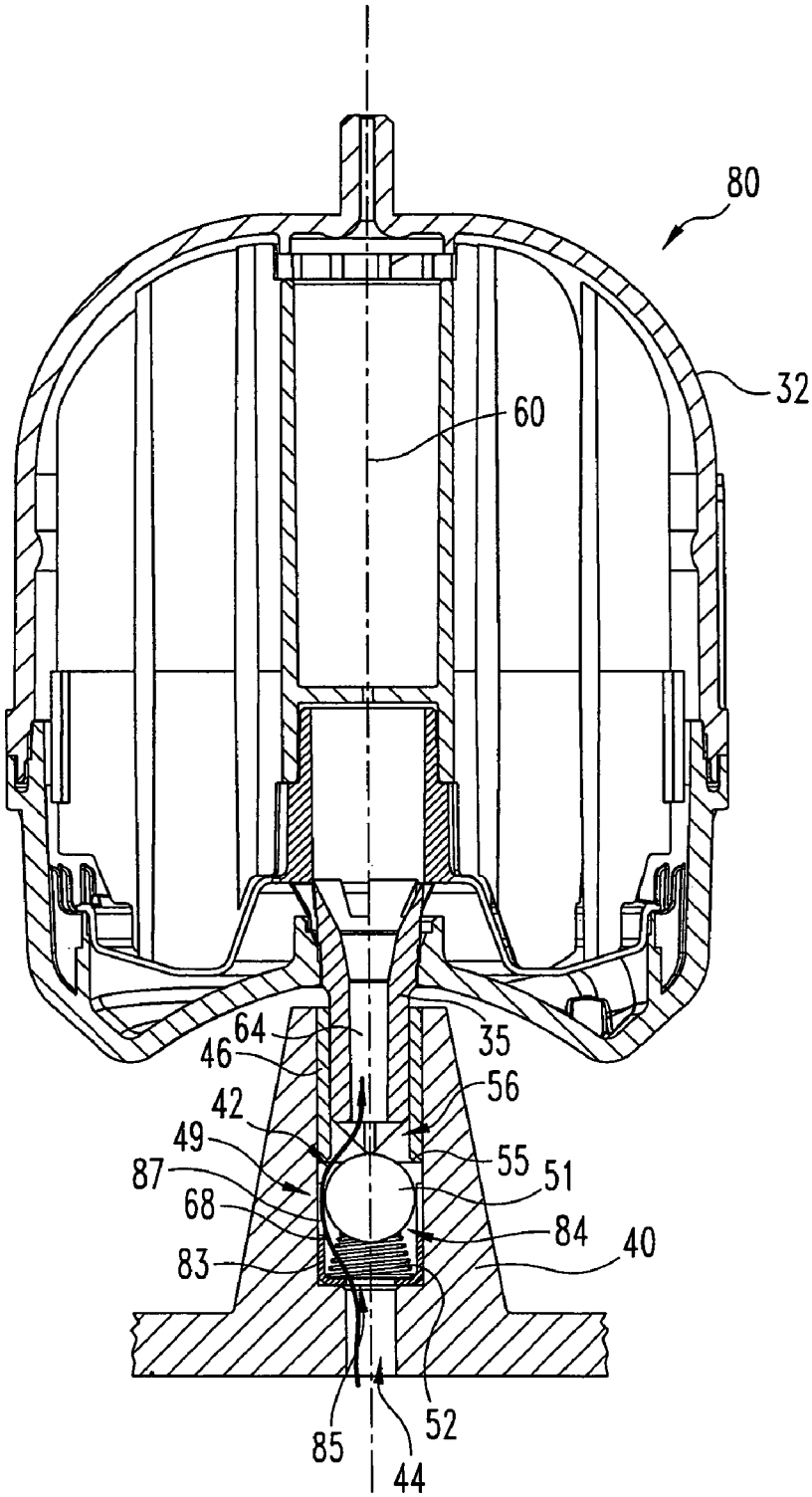
FIG. 5 is a cross-sectional view of a centrifuge assembly according to another embodiment.
Figure 6:
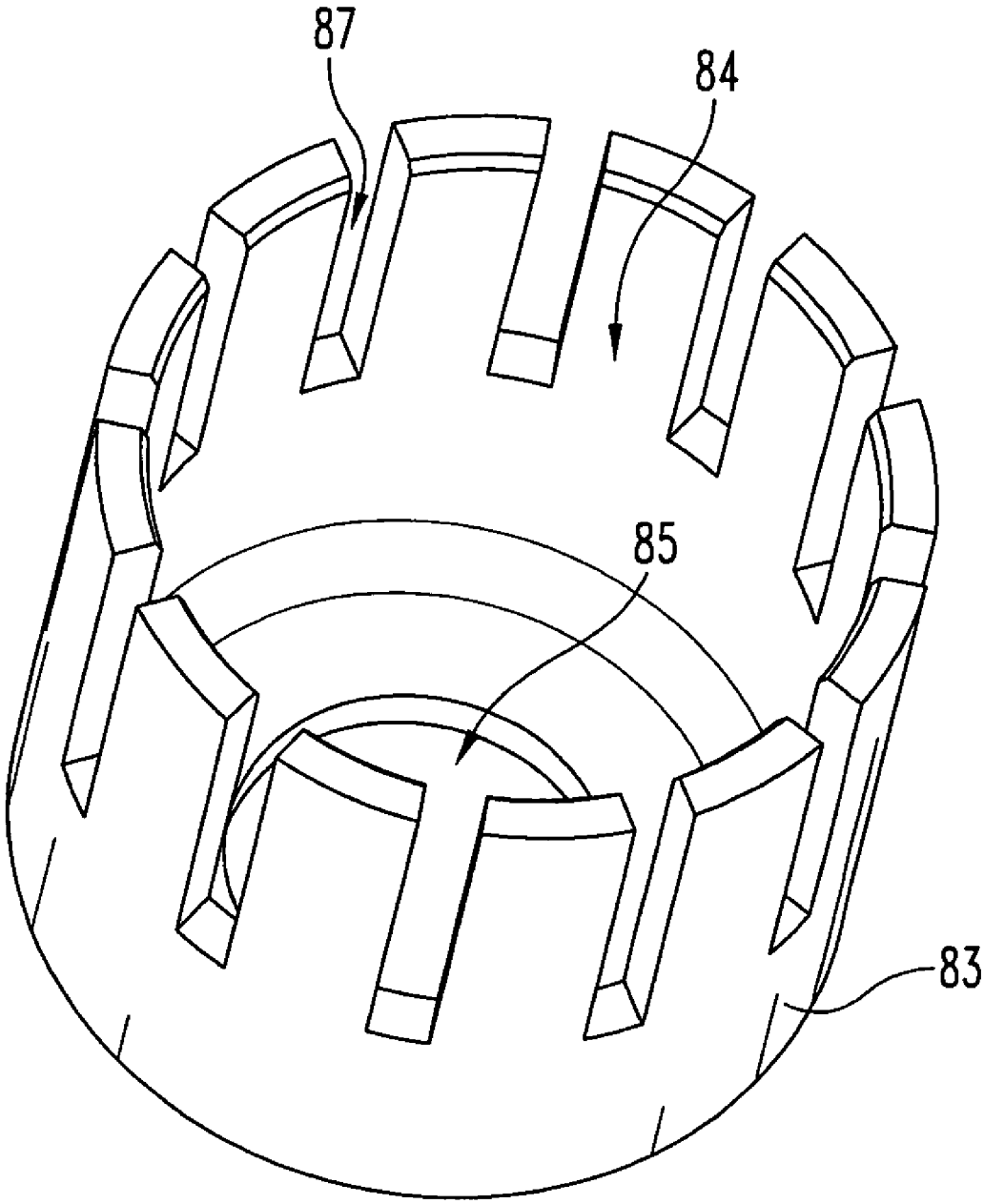
FIG. 6 is a perspective view of a valve cage for the FIG. 5 centrifuge.

A centrifuge assembly 80 according to another embodiment is illustrated in FIG. 5. The centrifuge 80 in FIG. 5 includes all of the components of the FIG. 1 centrifuge 30, but the centrifuge 80 in FIG. 5 further includes a valve cage 83 that aligns or centers the seal member 51 in the axle cavity 42 so that the seal member 51 is able to seal properly against the valve seat 55. Further, the cage 83 ensures that the seal member 51 is not offset from the longitudinal axis 60 so as to minimize torque between the axle 35 and the valve 49. Referring to FIGS. 5 and 6, the cage 83 is generally cylindrical or cup shaped, and has a seal member cavity 84 in which the seal member 51 is received. At one end, the cage 83 has a flow opening 85 through which the fluid from the inlet port 44 flows. Disposed circumferentially around the seal member cavity 84, the cage 83 has one or more flow slots or notches 87, through which the fluid flows, as is indicated by flow arrows 68 in FIG. 5. As should be recognized, the FIG. 5 centrifuge operates generally in the same fashion as was described above with reference to the FIG. 1 embodiment, with the exception that the cage 83 now centers the seal member 51 during sealing against the bearing 46, and once the valve 49 is opened, the fluid flows through the flow slots 87 in the cage 83. As should be recognized, the cage 83 can be incorporated into other embodiments.

Figure 7:
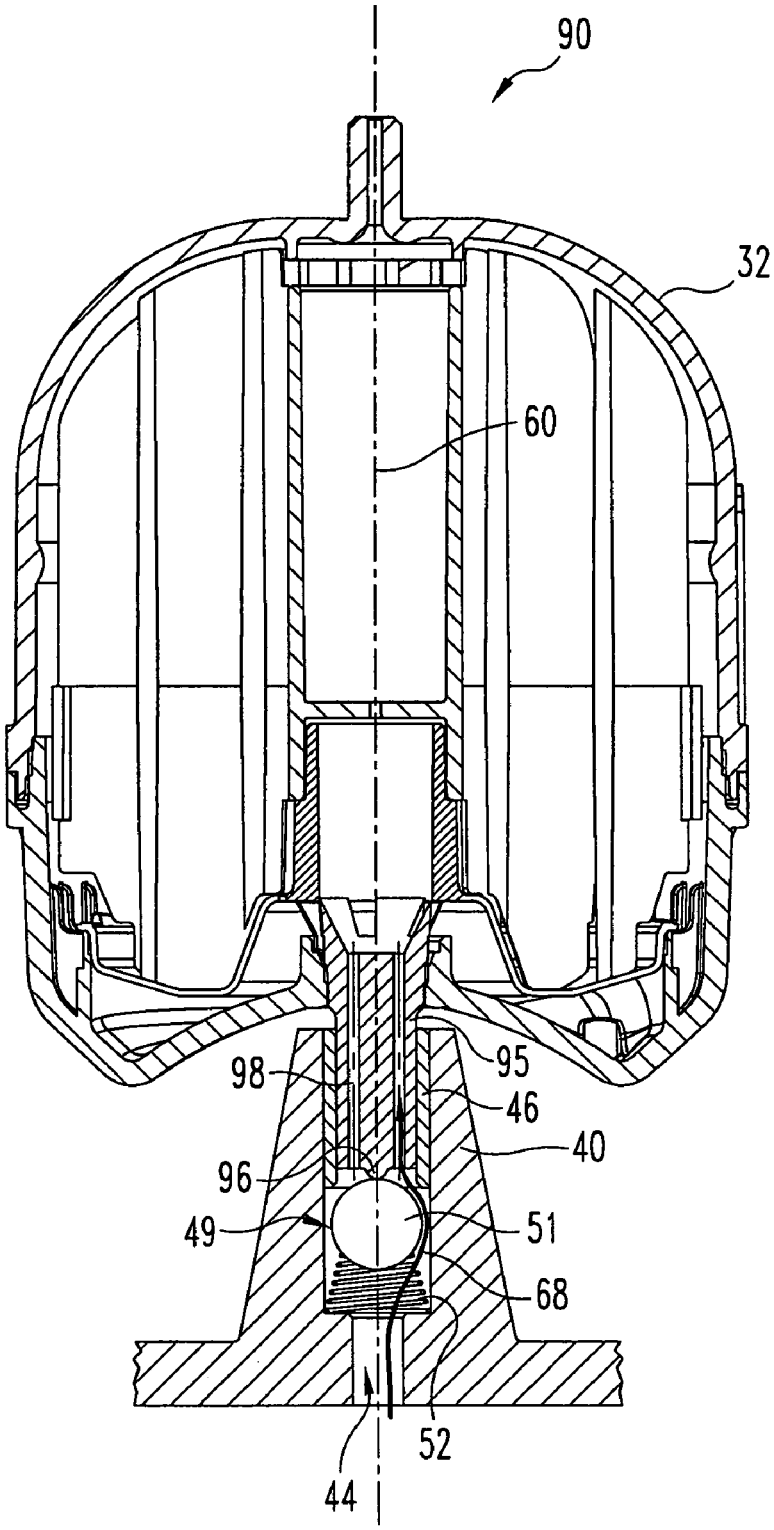
FIG. 7 is a cross-sectional view of a centrifuge assembly according to still yet another embodiment.
Figure 8:
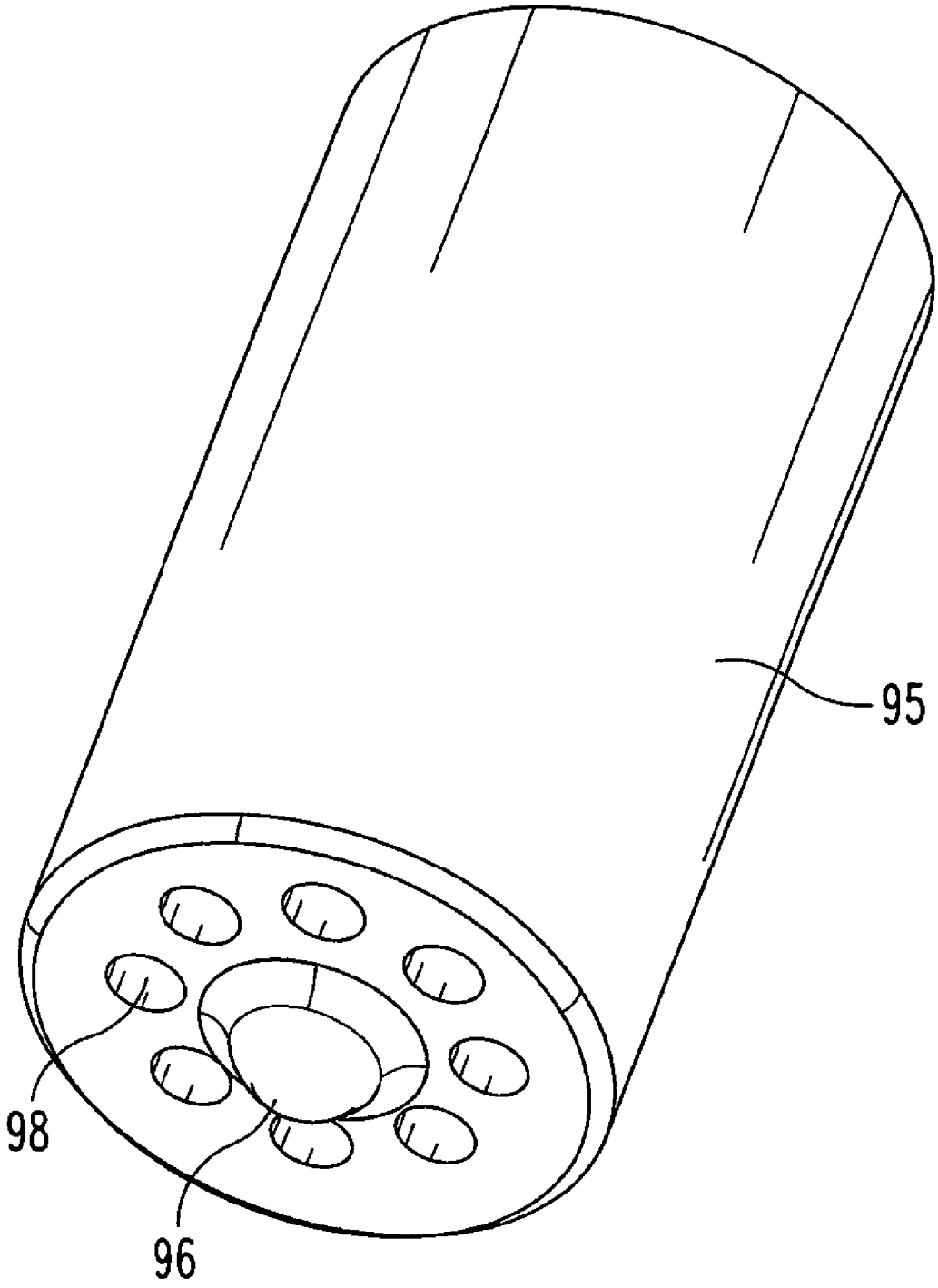
FIG. 8 is a perspective view of an axle or spud for the FIG. 7 centrifuge.

FIGS. 7 and 8 illustrate a centrifuge assembly 90 according to another embodiment. As should be recognized, the centrifuge 90 in FIG. 7 shares a number of components in common with the centrifuge 30 of FIG. 1, and for the sake of brevity and clarity, these common components will not be again discussed in great detail below. In the FIG. 7 embodiment, however, the rotor 32 has an axle 95 that is configured differently from the axle 35 in the FIG. 1 embodiment. With reference to FIG. 8, the axle 95 includes a protrusion 96, which is in the form of a dimple, for actuating the valve 49. The protrusion 96 is aligned with the longitudinal axis 60 of the rotor 32 so as to minimize torque between the axle 95 and the valve 49. The axle 95 further has a series of one or more fluid passageways 98 circumferentially spaced around the protrusion 96 for transporting the fluid through the axle 95 and into the rotor 32, as is depicted with arrow 68 in FIG. 7. Like the previous embodiments, the axle 95 is received in the bearing 46, during installation, and the axle 95 operates in a generally similar fashion as those described above, in which the protrusion 96 of the axle 95 contacts the seal member 51 to open the valve 49. If the wrong rotor or no rotor is installed, then the valve 49 remains closed, thereby preventing fluid pressure loss.

Figure 9:
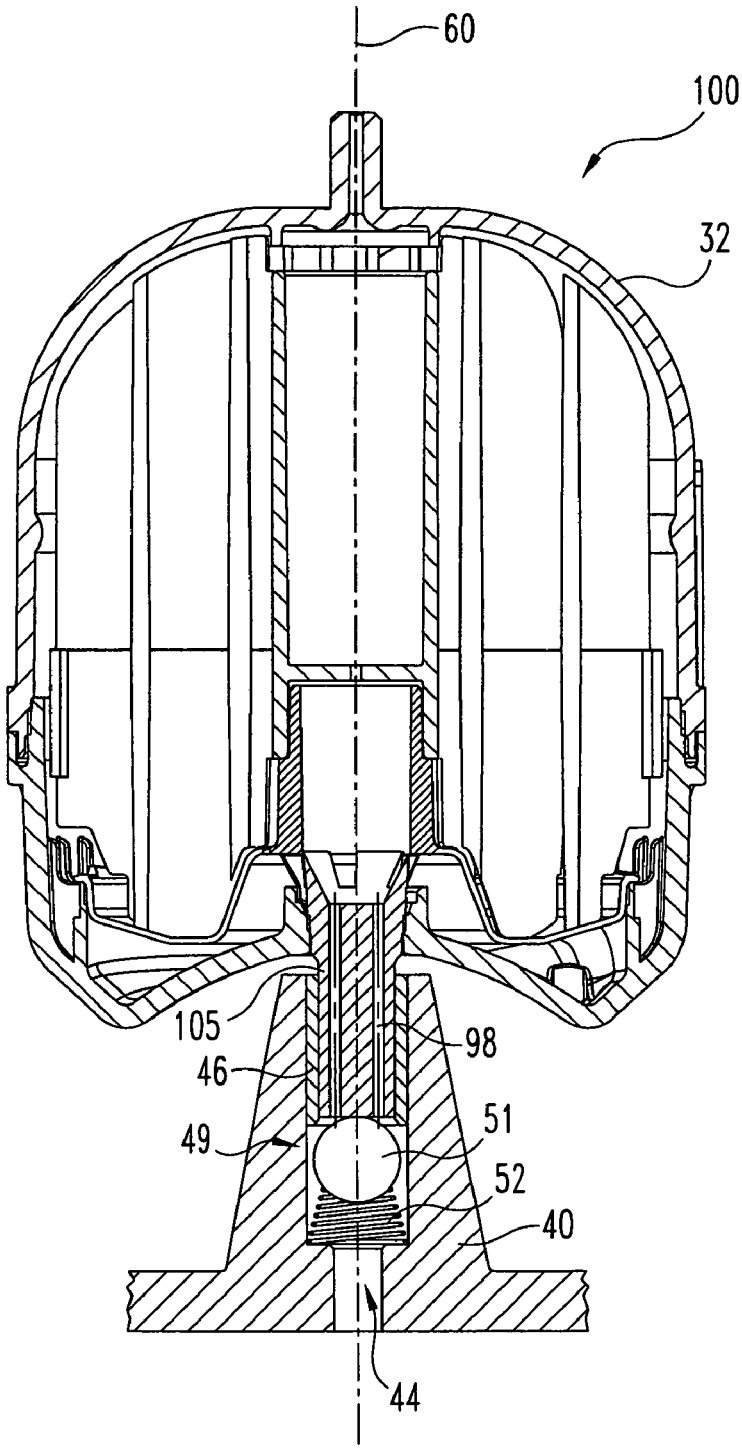
FIG. 9 is a cross-sectional view of a centrifuge assembly according to a further embodiment.

A centrifuge assembly 100 according to still yet another embodiment is illustrated in FIG. 9. The centrifuge 100 in the FIG. 9 embodiment includes the same components as the one illustrated in FIG. 7, but the FIG. 9 centrifuge 100 has an axle 105 that slightly differs from the FIG. 7 axle 95. In particular, although the axle 105 has the series of circumferentially spaced flow passages 98, the end of the axle 105 that contacts the seal member 51 is generally flat, that is, the axle 105 of FIG. 9 lacks the protrusion 96 on the axle 95 shown in FIGS. 7 and 8. Although the end of the axle 105 is generally flat, since the seal member 51 in the illustrated embodiment is generally spherical, a point contact is formed along the longitudinal axis 60 between the axle 105 and the seal member 51 such that the torque applied between the two is minimal. It, however, is envisioned that in other embodiments a point contact between the axle 98 and the seal member 51 is not required. For example, in one embodiment, both the end of the axle 105 and the seal member 51 can have flat surfaces that contact one another, but the seal member 51 rests on a bearing or has some other structure that allows the seal member 51 to rotate freely. In the illustrated embodiment, the length of the axle 105 in FIG. 9 is long enough to unseat the seal member 51 from the bearing 46 when the rotor 32 is installed. The centrifuge 100 operates in a similar fashion to the ones described above. For instance, if a rotor has an axle that is too short or if no rotor is installed, then the valve 49 remains closed, thereby preventing fluid pressure loss.

While the invention has been illustrated and described in detail in the drawings and foregoing description, the same is to be considered as illustrative and not restrictive in character. It should be understood that only the preferred embodiments have been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

What is claimed is:

1. A centrifuge, comprising:

a rotor to clean fluid;

an axle extending from the rotor, the axle defining one or more flow passages through which the fluid is supplied to the rotor;

a check valve configured to shutoff flow of the fluid when a wrong rotor type is installed to prevent pressure loss;

the axle having an end contacting the check valve to open the check valve when the rotor is installed; and wherein the check valve includes: a valve member, and wherein the check valve is normally biased towards a closed position where the flow of fluid is shutoff; and a bias member to bias the valve member to the closed position, wherein the valve member includes a ball, and the bias member includes a spring.

2. The centrifuge of claim 1, wherein the end of the axle includes a protrusion configured to open the check valve.

3. The centrifuge of claim 1, further comprising a cage in which the valve member is disposed for centering the valve member.

4. The centrifuge of claim 1, wherein the one or more flow passages are disposed axially within the axle.

5. The centrifuge of claim 4, wherein the check valve shuts off flow of the fluid at an inlet of the axle.

6. A centrifuge, comprising:

a rotor to clean fluid;

an axle extending from the rotor, the axle defining one or more flow passages through which the fluid is supplied to the rotor;

a valve configured to shutoff flow of the fluid when the rotor is absent or a wrong rotor type is installed to prevent pressure loss;

the axle having an end contacting the valve to open the valve when the rotor is installed;

a housing defining an axle cavity;

a bearing disposed in the axle cavity, the axle being rotatably received in the bearing; and wherein the valve is disposed in the axle cavity and the bearing is disposed in the axle cavity to retain the valve in the axle cavity.

7. The centrifuge of claim 6, wherein the valve is a check valve and wherein the bearing is disposed at a position in the axle cavity to retain the check valve in the axle cavity.

8. The centrifuge of claim 6, wherein the bearing includes a journal bearing.

9. The centrifuge of claim 6, wherein the bearing includes a seat surface against which the check valve seals to shutoff the flow of the fluid.

10. The centrifuge of claim 6, wherein the one or more flow passages are disposed axially within the axle.

11. The centrifuge of claim 10, wherein the valve shuts off flow of the fluid at an inlet of the axle.

12. The centrifuge of claim 6, wherein the valve comprises a ball disposed within the housing such that pressure from the fluid biases the ball to a closed position when the rotor is absent or a wrong rotor type is installed.

13. The centrifuge of claim 6, wherein the valve comprises: a ball disposed within the housing, and a bias member to bias the ball to a closed position when the rotor is absent or a wrong rotor type is installed.

14. A centrifuge, comprising:

a rotor to clean fluid;

an axle extending from the rotor, the axle defining one or more flow passages through which the fluid is supplied to the rotor;

a check valve configured to shutoff flow of the fluid when the rotor is absent or a wrong rotor type is installed to prevent pressure loss;

the axle having an end contacting the valve to open the valve when the rotor is installed;

the rotor has a central longitudinal axis about which the rotor rotates;

the axle includes a protrusion configured to contact the check valve to open the check valve; and the protrusion is disposed along the central longitudinal axis to minimize torque between the axle and the check valve.

15. The centrifuge of claim 14, wherein the protrusion includes one or more arrow shaped ribs that form a point where the axle contacts the check valve.

16. The centrifuge of claim 14, wherein the protrusion includes a dimple.

17. The centrifuge of claim 14, wherein the axle has a plurality of the flow passages circumferentially disposed around the axle.

18. The centrifuge of claim 14, wherein the rotor is a shaft-less design to increase operational speed of the rotor.

19. The centrifuge of claim 14, wherein the rotor includes a self-driven Hero turbine type rotor that includes one or more jet orifices for driving the rotor.

* * * * *